US010082140B2

(12) United States Patent
Mizushima et al.

(10) Patent No.: US 10,082,140 B2
(45) Date of Patent: Sep. 25, 2018

(54) SCROLL COMPRESSOR HAVING COMPRESSION CHAMBER COMMUNICATING WITH DISCHARGE PORT VIA A GAP BETWEEN RECESSED PART FORMED ON FRONT FACE OF MOVABLE-SIDE PLATE AND TIP OF FIXED-SIDE LAP

(71) Applicant: DAIKIN INDUSTRIES, LTD., Osaka-shi, Osaka (JP)

(72) Inventors: Yasuo Mizushima, Sakai (JP); Yasuhiro Murakami, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/534,419

(22) PCT Filed: Dec. 3, 2015

(86) PCT No.: PCT/JP2015/084049
§ 371 (c)(1),
(2) Date: Jun. 8, 2017

(87) PCT Pub. No.: WO2016/093151
PCT Pub. Date: Jun. 16, 2016

(65) Prior Publication Data

US 2017/0342981 A1 Nov. 30, 2017

(30) Foreign Application Priority Data

Dec. 12, 2014 (JP) ..... 2014-252265

(51) Int. Cl.
*F03C 2/00* (2006.01)
*F03C 4/00* (2006.01)
(Continued)

(52) U.S. Cl.
CPC ..... *F04C 18/0215* (2013.01); *F04C 18/0246* (2013.01); *F04C 18/0253* (2013.01);
(Continued)

(58) Field of Classification Search
CPC ..... F04C 18/0215; F04C 18/0253; F04C 18/0269; F04C 18/0246; F04C 15/0049;
(Continued)

(56) References Cited

U.S. PATENT DOCUMENTS

2007/0178002 A1* 8/2007 Hiwata ..... F04C 18/0215 418/55.2
2011/0088863 A1* 4/2011 Yamamoto ..... B22D 18/04 164/284

FOREIGN PATENT DOCUMENTS

JP 2010-265756 A 11/2010
JP 2011-149376 A 8/2011

OTHER PUBLICATIONS

International Preliminary Report of corresponding PCT Application No. PCT/JP2015/084049 dated Jun. 22, 2017.
(Continued)

*Primary Examiner* — Theresa Trieu
(74) *Attorney, Agent, or Firm* — Global IP Counselors, LLP

(57) ABSTRACT

A scroll compressor includes fixed and movable scrolls having a fixed and movable side plates and fixed and movable side laps to form first and second compression chambers. The fixed-side plate includes a discharge port and a relief hole extending from the front face through to the back face. The relief hole communicates for a predetermined amount of time with each of the first and second compression chambers and is shared by the first and second compression chambers. The front face of the movable-side plate includes a recessed part allowing the second compression
(Continued)

chamber and the discharge port to communicate. The second compression chamber, during a latter stage of compression, and the discharge port communicating via a gap formed between a tip of the fixed-side lap and the recessed part before communicating via a side face gap formed between the fixed-side lap and the movable-side lap.

6 Claims, 10 Drawing Sheets

(51) Int. Cl.

| | |
|---|---|
| ***F04C 2/00*** | (2006.01) |
| ***F04C 18/02*** | (2006.01) |
| ***F04C 29/02*** | (2006.01) |
| ***F04C 27/00*** | (2006.01) |
| *F04C 23/00* | (2006.01) |

(52) U.S. Cl.
CPC ..... *F04C 18/0269* (2013.01); *F04C 27/005* (2013.01); *F04C 29/028* (2013.01); *F04C 23/008* (2013.01); *F04C 29/023* (2013.01); *F04C 2230/602* (2013.01)

(58) Field of Classification Search
CPC .. F04C 27/005; F04C 29/0057; F04C 29/023; F04C 29/028; F04C 2230/602; F01C 1/0215; F01C 1/0246; F01C 1/0253; F01C 19/10
USPC ..... 418/55.1–55.6, 57, 15, 140, 142, 180; 417/310, 299
See application file for complete search history.

(56) References Cited

OTHER PUBLICATIONS

International Search Report of corresponding PCT Application No. PCT/JP2015/084049 dated Mar. 1, 2016.
European Search Report of corresponding EP Application No. 15 86 6725.3 dated Sep. 7, 2017.

* cited by examiner

SCROLL COMPRESSOR HAVING COMPRESSION CHAMBER COMMUNICATING WITH DISCHARGE PORT VIA A GAP BETWEEN RECESSED PART FORMED ON FRONT FACE OF MOVABLE-SIDE PLATE AND TIP OF FIXED-SIDE LAP

CROSS-REFERENCE TO RELATED APPLICATIONS

This U.S. National stage application claims priority under 35 U.S.C. § 119(a) to Japanese Patent Application No. 2014-252265, filed in Japan on Dec. 12, 2014, the entire contents of which are hereby incorporated herein by reference.

TECHNICAL FIELD

The present invention relates to a scroll compressor.

BACKGROUND ART

Currently, it is required for scroll compressors being used in refrigerating devices and the like, a capability in which a single unit can efficiently operate under a wide range of conditions ranging from high-speed/high-pressure ratio conditions to low-speed/low-pressure ratio conditions.

In particular, in order to improve operating efficiency of a scroll compressor under low-speed/low-pressure ratio conditions, Japanese Laid-open Patent Publication 2011-149376 discloses a scroll compressor having a relief hole, which is shared by an A chamber and a B chamber of a compression chamber, formed on a bottom of a fixed scroll (on a fixed-side plate) and suppressing over-compression loss. It is noted that the A chamber refers to a compression chamber that is circumscribed and formed by an outer peripheral face of a lap of a movable scroll and an inner peripheral face of a lap of the fixed scroll. The B chamber refers to a compression chamber that is circumscribed and formed by an inner peripheral face of the lap of the movable scroll and an outer peripheral face of the lap of the fixed scroll. In Patent Literature 1 (Japanese Laid-open Patent Publication 2011-149376, relief holes are not individually provided to each of the A chamber and B chamber, and instead, by providing the shared relief hole, it is possible to suppress deterioration of efficiency due to an increase in dead volume while suppressing over-compression loss.

SUMMARY

Technical Problem

However, in a case where the relief hole shared by the A chamber and B chamber is formed, as in Japanese Laid-open Patent Publication 2011-149376, arranging the relief hole in a position which can efficiently suppress both the over-compression loss of the A chamber and the over-compression loss of the B chamber presents a design difficulty. Conventionally, particularly when operating a scroll compressor under low-speed/low-pressure ratio conditions, a state has therefore arisen in which, even when it is possible to adequately suppress over-compression loss of the A chamber with the relief hole, over-compression loss of the B chamber cannot be adequately suppressed, potentially leading to scenarios where high-efficiency operation is difficult.

A problem of the present invention is to provide a scroll compressor capable of effectively suppressing over-compression loss in both an A chamber and a B chamber.

Solution to Problem

A scroll compressor according to a first aspect is provided with a fixed scroll and a movable scroll. The fixed scroll includes a fixed-side plate, and a fixed-side lap that extends from a front face of the fixed-side plate. The movable scroll includes a movable-side plate, and a movable-side lap that extends from a front face of the movable-side plate. The fixed-side lap and the movable-side lap are coupled in a state where the front face of the fixed-side plate and the front face of the movable-side plate face each other, forming a first compression chamber circumscribed by an outer peripheral face of the movable-side lap and an inner peripheral face of the fixed-side lap, and a second compression chamber circumscribed by an inner peripheral face of the movable-side lap and an outer peripheral face of the fixed-side lap as compression chambers. A discharge port and a relief hole are respectively formed in the fixed-side plate, running from the front face through to a back face. The relief hole communicates for a predetermined amount of time with each of the first compression chamber and the second compression chamber. The relief hole is shared by the first compression chamber and the second compression chamber. A recessed part, which allows the second compression chamber and the discharge port to communicate, is formed on the front face of the movable-side plate. The second compression chamber, which is in a latter stage of compression, and the discharge port communicate via a gap between a tip of the fixed-side lap and the recessed part before communicating via a side face gap between the fixed-side lap and the movable-side lap.

In a case where a scroll compressor is provided with a relief hole which is shared by a first compression chamber and a second compression chamber, in low-speed/low-pressure ratio conditions, it is difficult to adequately suppress over-compression loss of both the first compression chamber and the second compression chamber with only the relief hole. Specifically, when attempting to allow the second compression chamber and the relief hole to communicate prior to the second compression chamber in the latter stage of compression and the discharge port communicating via the side face gap between the fixed-side lap and the movable-side lap in order to adequately suppress over-compression loss of the second compression chamber, a position of the relief hole needs to be shifted to an earlier stage side. When the relief hole is arranged in this way, contrarily, the over-compression loss of the first compression chamber can no longer be adequately suppressed.

In contrast, in the scroll compressor according to the first aspect, the recessed part is formed on the movable-side plate, and prior to communicating via the side face gap between the fixed-side lap and the movable-side lap, the second compression chamber and the discharge port communicate via the gap between the tip of the fixed-side lap and the recessed part of the movable-side plate. Therefore, the over-compression loss of the second compression chamber can be suppressed using the recessed part and the relief hole while maximally suppressing the over-compression loss of the first compression chamber using the relief hole, and the over-compression loss of both compression chambers can be effectively suppressed.

Also, in the aspect described above, an increase in dead volume of the compression chambers can be suppressed as compared to a case where separate and independent relief holes are provided to the first compression chamber and the second compression chamber.

A scroll compressor according to a second aspect is the scroll compressor according to the first aspect, the recessed part including a step. The recessed part is divided by the step into a first recessed part and a second recessed part, which has a deeper recessed depth than the first recessed part. In the latter stage of compression of the second compression chamber, an edge part of the tip of the fixed-side lap on the outer peripheral face side of the fixed-side lap faces the second recessed part after facing the first recessed part.

According to the aspect described above, the recessed part includes the step and is provided with the first recessed part, which is capable of restricting the gap with the tip of the fixed-side lap to be comparatively small. In addition, the edge part of the tip of the fixed-side lap on the outer peripheral face side of the fixed-side lap faces the first recessed part prior to facing the second recessed part, which has a deeper recessed depth. Therefore, when communication between the second compression chamber and the discharge port via the recessed part begins, the gap between the recessed part (first recessed part) and the tip of the fixed-side lap can be kept comparatively small, and channel resistance can be kept comparatively high during high-speed/high-pressure ratio operation, where a refrigerant circulating volume is large. Accordingly, it is possible to suppress an increase in reverse flow loss due to inadequate compression during high-speed/high-pressure ratio operation.

A scroll compressor according to a third aspect is the scroll compressor according to the second aspect, in which in the latter stage of compression of the second compression chamber, the second compression chamber and the relief hole communicate with each other after the edge part of the tip of the fixed-side lap on the outer peripheral face side of the fixed-side lap faces the second recessed part.

According to the aspect described above, before the relief hole communicates with the second compression chamber, the second compression chamber and the discharge port communicate via the gaps between the tip of the fixed-side lap and the first and second recessed parts, and refrigerant flows from the second compression chamber through these gaps and into the discharge port. Therefore, when the scroll compressor is operated under low-speed/low-pressure ratio conditions, over-compression loss of the second compression chamber is readily suppressed.

A scroll compressor according to a fourth aspect is the scroll compressor according to the second aspect, in which in the latter stage of compression of the second compression chamber, the second compression chamber and the relief hole communicate with each other after the edge part of the tip of the fixed-side lap on the outer peripheral face side of the fixed-side lap faces the first recessed part and before the edge part of the tip of the fixed-side lap on the outer peripheral face side faces the second recessed part.

According to the aspect described above, before the relief hole communicates with the second compression chamber, the second compression chamber and the discharge port communicate via the gap between the tip of the fixed-side lap and the first recessed part, and refrigerant flows from the second compression chamber through this gap and into the discharge port. Therefore, when the scroll compressor is operated under low-speed/low-pressure ratio conditions, over-compression loss of the second compression chamber is readily suppressed.

A scroll compressor according to a fifth aspect is the scroll compressor according to any one of the second to fourth aspects, a ratio of an opening area formed at the gap between the tip of the fixed-side lap and the first recessed part and an opening area of the discharge port being equal to a ratio of a minimum rotating speed and a maximum rotating speed of the scroll compressor.

According to the aspect described above, the ratio of the opening area of the gap between the tip of the fixed-side lap and the first recessed part, and the opening area of the discharge port, which is capable of suppressing channel resistance in a case where a compressor is at the maximum rotating speed, is equal to the ratio of the minimum rotating speed and the maximum rotating speed of the scroll compressor. Therefore, while suppressing over-compression loss at low-speed/low-pressure ratio conditions, at high-speed/high-pressure ratio conditions, channel resistance of the gap between the tip of the fixed-side lap and the first recessed part can be kept comparatively high, and an increase in reverse flow loss due to inadequate compression can be thereby suppressed.

Advantageous Effects of Invention

In a case where a scroll compressor is provided with a relief hole which is shared by a first compression chamber and a second compression chamber, in low-speed/low-pressure ratio conditions, it is difficult to adequately suppress over-compression loss of both the first compression chamber and the second compression chamber with only the relief hole. Specifically, when attempting to allow the second compression chamber and the relief hole to communicate prior to the second compression chamber in a latter stage of compression and the discharge port communicating via a side face gap between the fixed-side lap and the movable-side lap in order to adequately suppress over-compression loss of the second compression chamber, a position of the relief hole needs to be shifted to an earlier stage side. When the relief hole is arranged in this way, contrarily, the over-compression loss of the first compression chamber can no longer be adequately suppressed.

In contrast, in the scroll compressor according to the present invention, the recessed part is formed on the movable-side plate, and prior to communicating via the side face gap between the fixed-side lap and the movable-side lap, the second compression chamber and the discharge port communicate via the gap between the tip of the fixed-side lap and the recessed part of the movable-side plate. Therefore, the over-compression loss of the second compression chamber can be suppressed using the recessed part and the relief hole while maximally suppressing the over-compression loss of the first compression chamber using the relief hole, and the over-compression loss of both compression chambers can be effectively suppressed. Also, an increase in dead volume of the compression chambers can be suppressed as compared to a case where separate and independent relief holes are provided to the first compression chamber and the second compression chamber.

BRIEF DESCRIPTION OF THE DRAWINGS

FIG. 8 illustrating, in a plan view, a state where a left-side end part of a first-opening recessed part overlaps an outer peripheral face of the fixed-side lap;

FIG. 9 illustrating, in a plan view, a state where a right-side end part of the first-opening recessed part (a left-side end part of a discharge counterbored part) overlaps the outer peripheral face of the fixed-side lap, FIG. 9 also illustrating a state immediately prior to a second compression chamber communicating with the discharge port via the side face gap between the fixed-side lap and the movable-side lap;

DESCRIPTION OF EMBODIMENTS

A scroll compressor according to an embodiment of the present invention shall now be described with reference to the drawings. It is noted that the embodiment presented below is merely exemplary and can be modified in a range that do not depart from the substance of the present invention.

(1) Overall Configuration

A scroll compressor 10 according to the present embodiment is described. The scroll compressor 10 is mounted, for example, to an outdoor unit of an air conditioner and configures a portion of a refrigerant circuit of the air conditioner.

Figure 1:
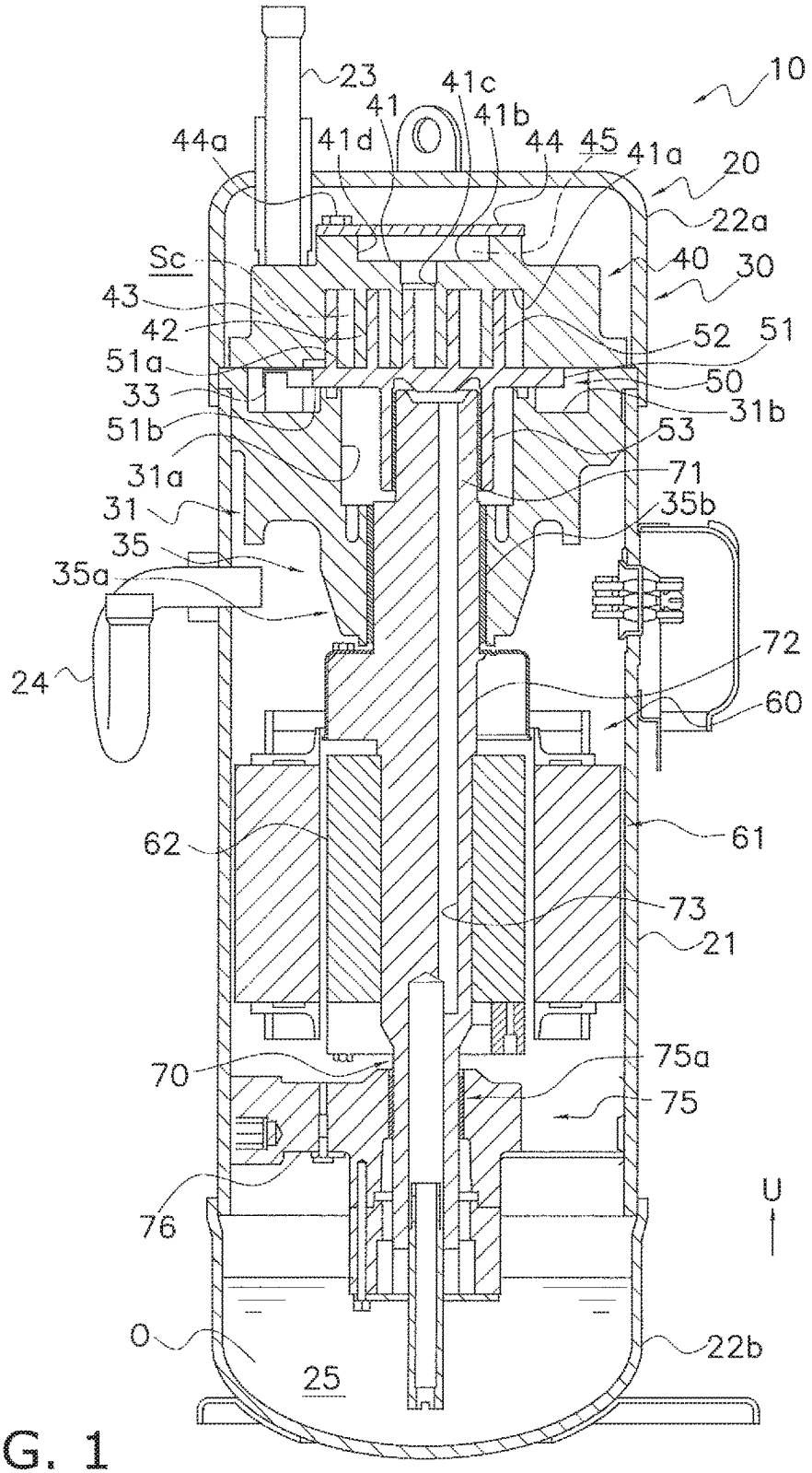
FIG. 1 is a vertical sectional view of a scroll compressor according to an embodiment of the present invention.

FIG. 1 is a general vertical sectional view of the scroll compressor 10 according to one embodiment.

The scroll compressor 10, as shown in FIG. 1, primarily includes a casing 20, a compression mechanism 30, a drive motor 60, a crankshaft 70, and a lower bearing 75. The compression mechanism 30 includes a fixed scroll 40 and a movable scroll 50 (see FIG. 1).

(2) Detailed Configuration

The casing 20, the compression mechanism 30, the drive motor 60, the crankshaft 70, and the lower bearing 75 of the scroll compressor 10 are described in detail below.

It is noted that in the following description, expressions such as "upper," "lower," and the like may be used in order to describe directions and arrangements, and the direction of arrow U in FIG. 1 is defined as being upward when not otherwise specified. In addition, it is noted that in the following description, expressions such as "parallel," "orthogonal," and the like may be used, and these expressions include cases that are essentially parallel and/or orthogonal, i.e., cases that are substantially parallel and/or substantially orthogonal.

(2-1) Casing

The scroll compressor 10 has a vertically long cylindrical casing 20. The casing 20 includes a cylindrical cylinder member 21 which opens at a top and bottom, as well as an upper lid 22*a* and a lower lid 22*b* arranged respectively on upper and lower ends of the cylinder member 21. The cylinder member 21, and the upper lid 22*a* and the lower lid 22*b* are fixated by welding so as to maintain airtightness.

The casing 20 accommodates components of the scroll compressor 10, including the compression mechanism 30, the drive motor 60, the crankshaft 70, and the lower bearing 75.

An oil retention space 25 is formed in a lower part of the casing 20. A refrigerating machine oil O to lubricate the compression mechanism 30 and the like is retained in the oil retention space 25.

An intake tube 23, into which refrigerant to be compressed by the compression mechanism 30 is drawn, is arranged to an upper part of the casing 20, so as to pass through the upper lid 22*a* (see FIG. 1). A lower end of the intake tube 23 is connected to the fixed scroll 40 of the compression mechanism 30, which is described below. The intake tube 23 communicates with a compression chamber Sc of the compression mechanism 30 described below. Refrigerant being at low pressure and prior to compression (refrigerant that is at low pressure in the refrigerating cycle) flows into the intake tube 23.

A discharge tube 24, through which refrigerant to be discharged to an exterior of the casing 20 passes, is provided in an intermediate part of the cylinder member 21 of the casing 20 (see FIG. 1). The discharge tube 24 is arranged so that an end thereof inside the casing 20 protrudes below a housing 31 of the compression mechanism 30, described below. High-pressure refrigerant that has been compressed by the compression mechanism 30 (refrigerant that is at high pressure in the refrigerating cycle) flows into the discharge tube 24.

(2-2) Compression Mechanism

As shown in FIG. 1, the compression mechanism 30 primarily includes the housing 31, the fixed scroll 40 arranged above the housing 31, and the movable scroll 50 that forms the compression chamber Sc in combination with the fixed scroll 40. The compression mechanism 30 is an asymmetric spiral structure-type (asymmetric lap-type) scroll compressor.

(2-2-1) Fixed Scroll

The fixed scroll 40 has a disc-like fixed-side plate 41, a spiraling (involute-shaped) fixed-side lap 42 that extends downward from a front face 41*a* (lower surface) of the fixed-side plate 41, and a peripheral part 43 that surrounds the fixed-side lap 42.

A non-circular discharge port 41*c* that communicates with the compression chamber Sc, described below, is formed substantially in the center of the fixed-side plate 41 so as to pass the fixed-side plate 41 in a thickness direction (vertical direction). In other words, the discharge port 41*c* extends through the fixed-side plate 41 from the front face 41*a* to a back face 41*b* (upper surface). An opening area A1 of the discharge port is designed to be a value capable of suppressing a rise in channel resistance even in a case where the drive motor 60 of the scroll compressor 10 is driven at a maximum rotating speed N1, described below, and an amount of refrigerant has increased.

Figure 3:
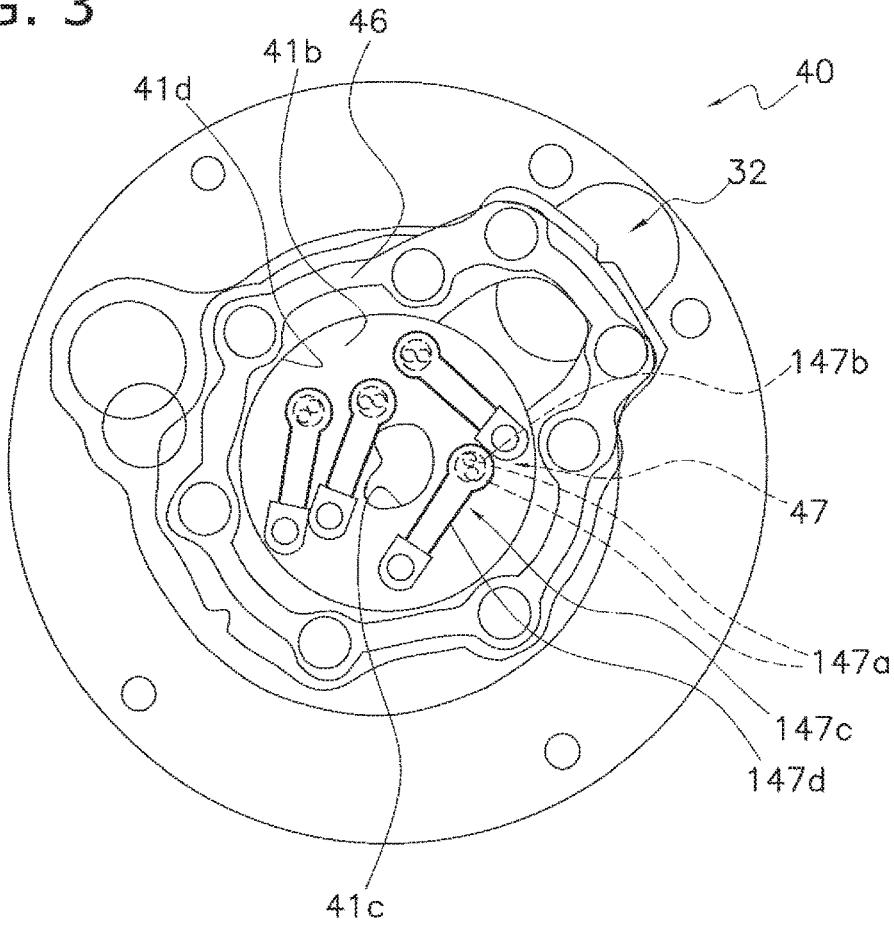
FIG. 3 is a plan view of the fixed scroll of the scroll compressor of FIG. 1 as seen from above, in a state where a lid body has been removed.

An enlarged recess 41*d* (see FIG. 1) is formed on the upper surface of the fixed-side plate 41 so as to recess downward. The enlarged recess 41*d* is a recessed part formed to have substantially a circular shape in a plan view (see FIG. 3). The enlarged recess 41*d* communicates with the discharge port 41*c* (see FIG. 1). A lid body 44 is fixated to an upper surface of the fixed scroll 40 by a bolt 44*a* so as to close off the enlarged recess 41*d* (see FIG. 1). A chamber 45 is formed between the enlarged recess 41*d* and the lid body 44 (see FIG. 1). It is noted that a gasket 46 (see FIG. 3) is arranged between the lid body 44 and the fixed-side plate 41, and that a space between the lid body 44 and the fixed-side plate 41 is sealed. The chamber 45 functions as a muffler space to reduce noise of the refrigerant passing through. It is noted that the chamber 45 communicates with a refrigerant passage 32, which is formed so as to run through the fixed scroll 40 and the housing 31 (see FIG. 3). The refrigerant passage 32 is a passage communicating with the chamber 45 and a high pressure space below the housing 31.

Figure 2:
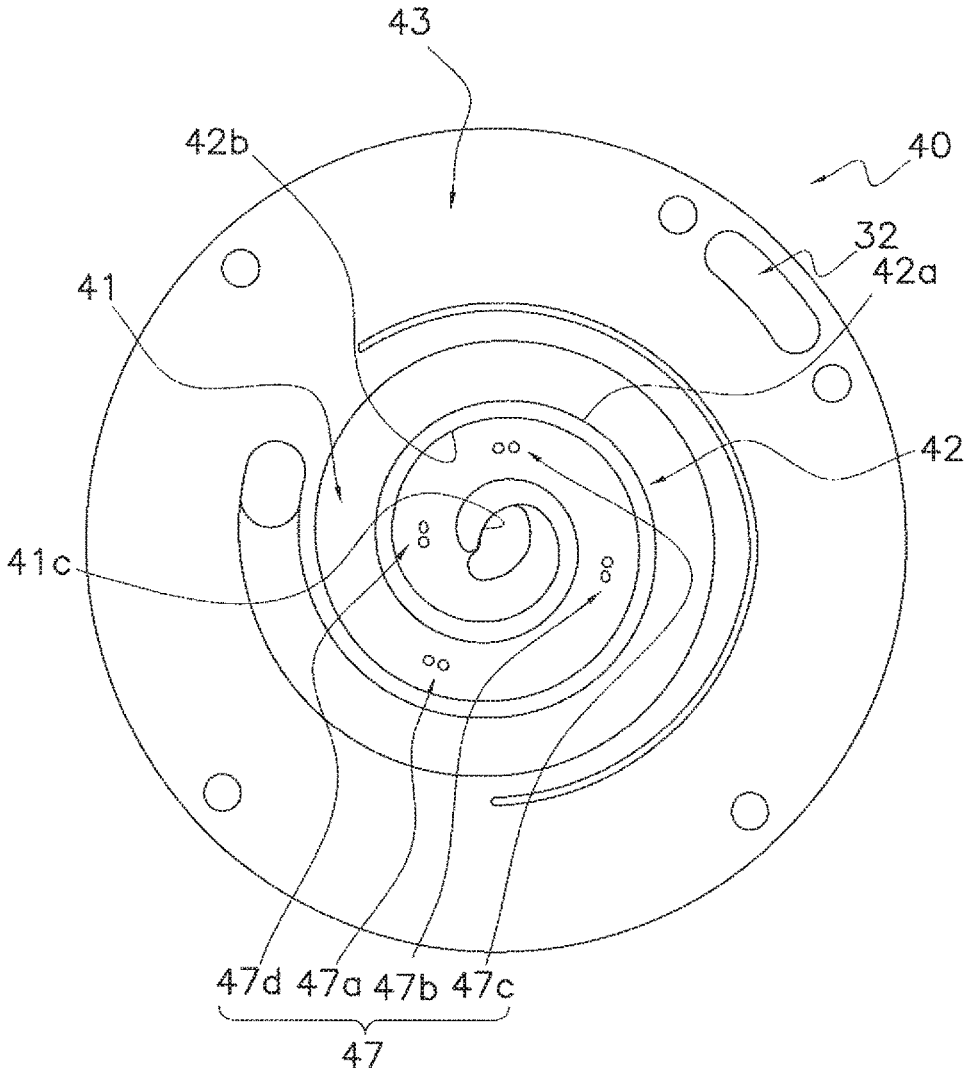
FIG. 2 is a plan view of a fixed scroll of the scroll compressor of FIG. 1 as seen from below.
Figure 5:
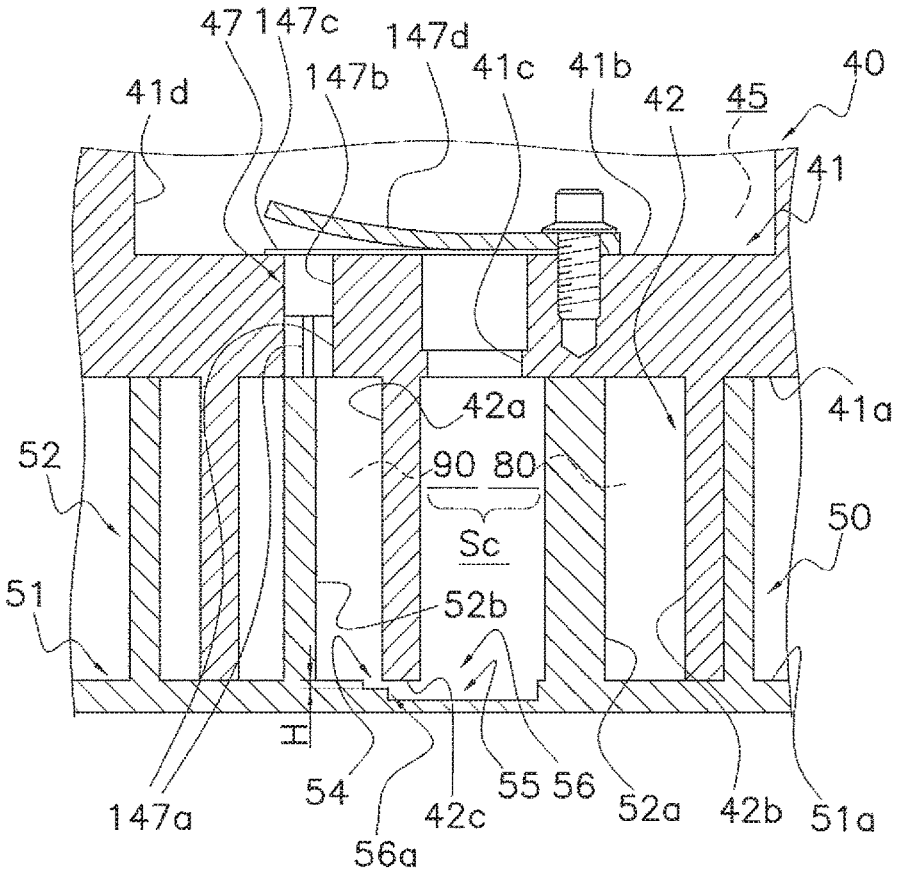
FIG. 5 is an enlarged, vertical sectional view of the fixed scroll and a movable scroll of the scroll compressor of FIG. 1, FIG. 5 being an enlarged, vertical sectional view on a center side (near a discharge port) of the fixed scroll and movable scroll.

A relief hole 47 is formed in the fixed-side plate 41, so as to pass the fixed-side plate 41 in the thickness direction (vertical direction; see FIG. 5). In other words, the relief hole 47 extends through the fixed-side plate 41 from the front face 41*a* to the back face 41*b*. Relief holes 47 (a first relief hole 47*a*, a second relief hole 47*b*, a third relief hole 47*c*, and a fourth relief hole 47*d*) are formed at four locations on the fixed-side plate 41 (see FIG. 2). The four groups of relief holes 47 are shared with the compression chamber Sc, and more specifically with a first compression chamber 80 and a second compression chamber 90 described below (see FIGS. 5 and 7 to 9). In other words, the four groups of relief holes 47 are used by both the first compression chamber 80 and the second compression chamber 90. The four groups of relief holes 47 are arranged such that the first compression chamber 80 and the second compression chamber 90 communicate with all of the relief holes 47 in a predetermined period of time during a single compression stroke cycle (between an intake stroke and a discharge stroke). It is noted that, as shown in FIG. 2, when the fixed-side plate 41 is viewed from the lower surface side, each of the relief holes 47 is arranged in a position away from the fixed-side lap 42; specifically, each of the relief holes 47 is arranged at an intermediate position between the neighboring fixed-side laps 42. In the present embodiment, the relief holes 47 formed on the fixed-side plate 41 are referred to, in order, along the fixed-side lap 42, from an outer periphery of the fixed-side plate 41 of the fixed-side lap 42, as the first relief hole 47*a*, the second relief hole 47*b*, the third relief hole 47*c*, and the fourth relief hole 47*d*. In other words, the first relief hole 47*a* is the relief hole 47 arranged at the outermost periphery side of the fixed-side plate 41 and the fourth relief hole 47*d* is the relief hole arranged at the most central side of the fixed-side plate 41. During one cycle, the first compression chamber 80 and the second compression chamber 90 each communicate with the relief holes 47 in the predetermined amount of time, in the order of the first relief hole 47*a*, the second relief hole 47*b*, the third relief hole 47*c*, and the fourth relief hole 47*d*.

A configuration such as that disclosed in Japanese Laid-open Patent Publication 2011-149376 can be applied to the relief holes 47.

For example, each of the relief holes 47 includes a pair of round holes 147*a* formed on the front face 41*a* side of the fixed-side plate 41, and a counterbored hole 147*b* formed on the back face 41*b* side of the fixed-side plate 41 and communicating with both of the pair of round holes 147*a* (see FIG. 5). The relief holes 47 extend through the fixed-side plate 41 from the front face 41*a* to the back face 41*b* due to the round holes 147*a* and the counterbored hole 147*b*.

Figure 4:
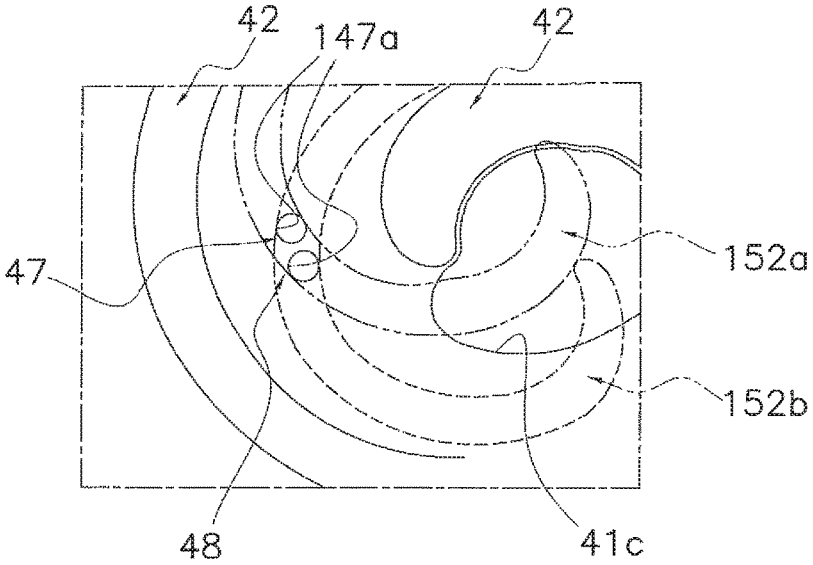
FIG. 4 is a view schematically showing an arrangement of relief holes formed in the fixed scroll of FIG. 1.

Each pair of round holes 147*a* is arranged within an interior of a region which locates at a position maximumly overlapping while the movable-side lap 52 reciprocatingly passing with respect to the round holes 147*a* when a movable-side lap 52 of the movable scroll 50 (described below) performs orbital motion, (a substantially diamond-shaped region 48 which is a portion where trajectories of the movable-side lap 52 of the movable scroll 50 overlap; see FIG. 4). FIG. 4 shows the reciprocating movable-side lap 52. An advancing direction movable-side lap 52 is indicated by 152*a* and a return direction movable-side lap 52 is indicated by 152*b* in FIG. 4. By arranging the pair of round holes 147*a* in this way, the opening area of the round holes 147*a* is likely to be adequately secured. In addition, a malfunction in which the first compression chamber 80 and the second compression chamber 90 communicate with each other through the relief holes 47 is likely to be reliably prevented. As for the position of the round holes 147*a*, at least a center of each of the round holes 147*a* may be arranged within an interior of the region 48. At least two of the round holes 147*a* are arranged along a longer diagonal line in a case where the region 48 is regarded as forming a diamond shape (see FIG. 4). The pair of round holes 147*a* are arranged so as to be in line along the fixed-side lap 42 (see FIG. 2). It is noted that a diameter of each of the round holes 147*a* is designed to be greater than a tooth thickness of a chamfered tip (not shown in the drawings) of the movable-side lap 52 of the movable scroll 50 and less than a tooth thickness of a center part of the movable-side lap 52 of the movable scroll.

The counterbored hole 147*b* (see FIG. 5) is arranged on the back face 41*b* side of the fixed-side plate 41 and communicates with both of the pair of round holes 147*a*. A relief valve 147*c* is arranged at an opening of the counterbored hole 147*b* that is on the back face 41*b* side of the fixed-side plate 41. The relief valve 147*c* is arranged in the enlarged recess 41*d*. The relief valve 147*c* is a check valve. A relief valve retainer 147*d*, which limits a range over which the relief valve 147*c* opens, is provided to the relief valve 147*c*.

The fixed-side lap 42 is formed as a spiral shape (involute shape) and projects downward from the front face 41*a* of the fixed-side plate 41. The fixed-side lap 42, and the movable-side lap 52 of the movable scroll 50 (described below) are coupled in a state where the front face 41*a* (lower surface) of the fixed-side plate 41 and a front face 51*a* (upper surface) of a movable-side plate 51 face each other, thereby forming the compression chamber Sc between the fixed-side lap 42 and the movable-side lap 52 which adjoin each other (see FIG. 1). It is noted that the compression chamber Sc includes an A chamber circumscribed and formed by an outer peripheral face 52*a* of the movable-side lap 52 of the movable scroll 50 and an inner peripheral face 42*b* of the fixed-side lap 42 of the fixed scroll 40; and a B chamber circumscribed and formed by an inner peripheral face 52*b* of the movable-side lap 52 of the movable scroll 50 and an outer peripheral face 42*a* of the fixed-side lap 42 of the fixed scroll 40 (see FIG. 5). In this embodiment, the A chamber is referred to as the first compression chamber 80 and the B chamber is referred to as the second compression chamber 90.

The peripheral part 43 is formed as a thick-walled ring and is arranged so as to surround the fixed-side lap 42 (see FIG. 2).

(2-2-2) Movable Scroll

The movable scroll 50 has the substantially disc-shaped movable-side plate 51, the spiraling (involute-shaped) movable-side lap 52 that extends upward from the front face 51*a* (upper surface) of the movable-side plate 51, and a boss part 53 formed in a cylindrical shape and projecting downward from the back face 51*b* (lower surface) of the movable-side plate 51 (see FIG. 1).

Figure 6:
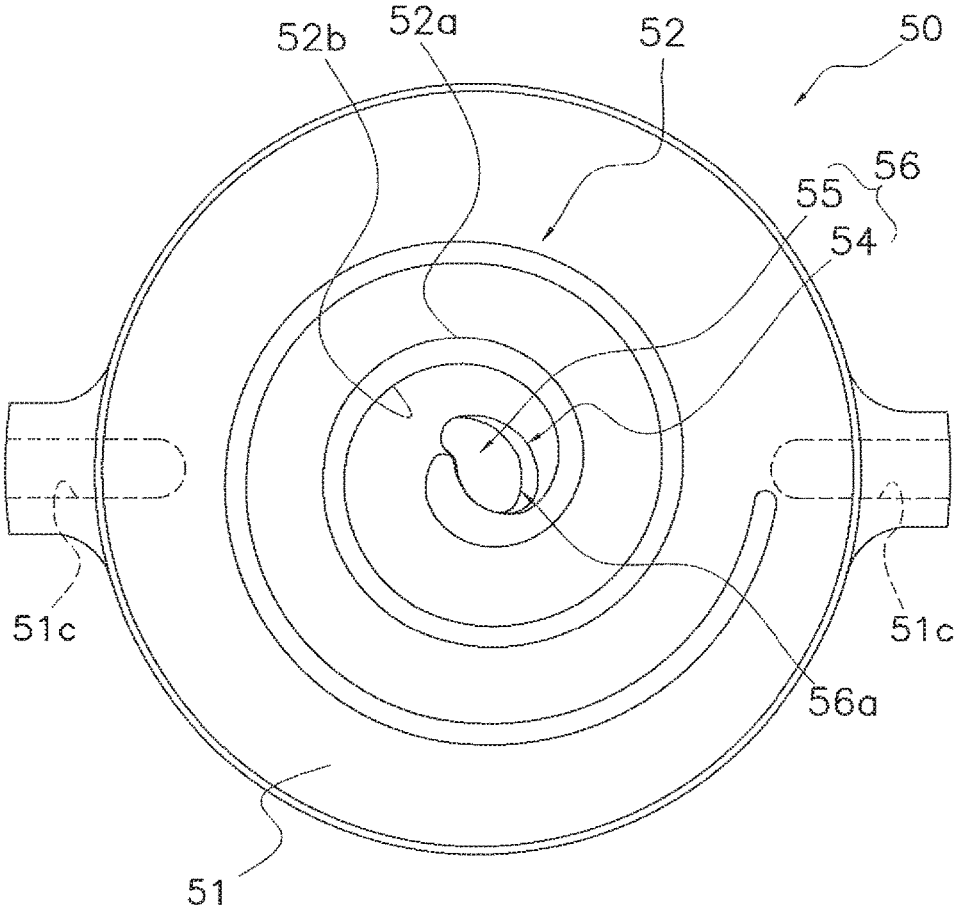
FIG. 6 is a plan view of the movable scroll of the scroll compressor of FIG. 1 as seen from above.
Figure 7:
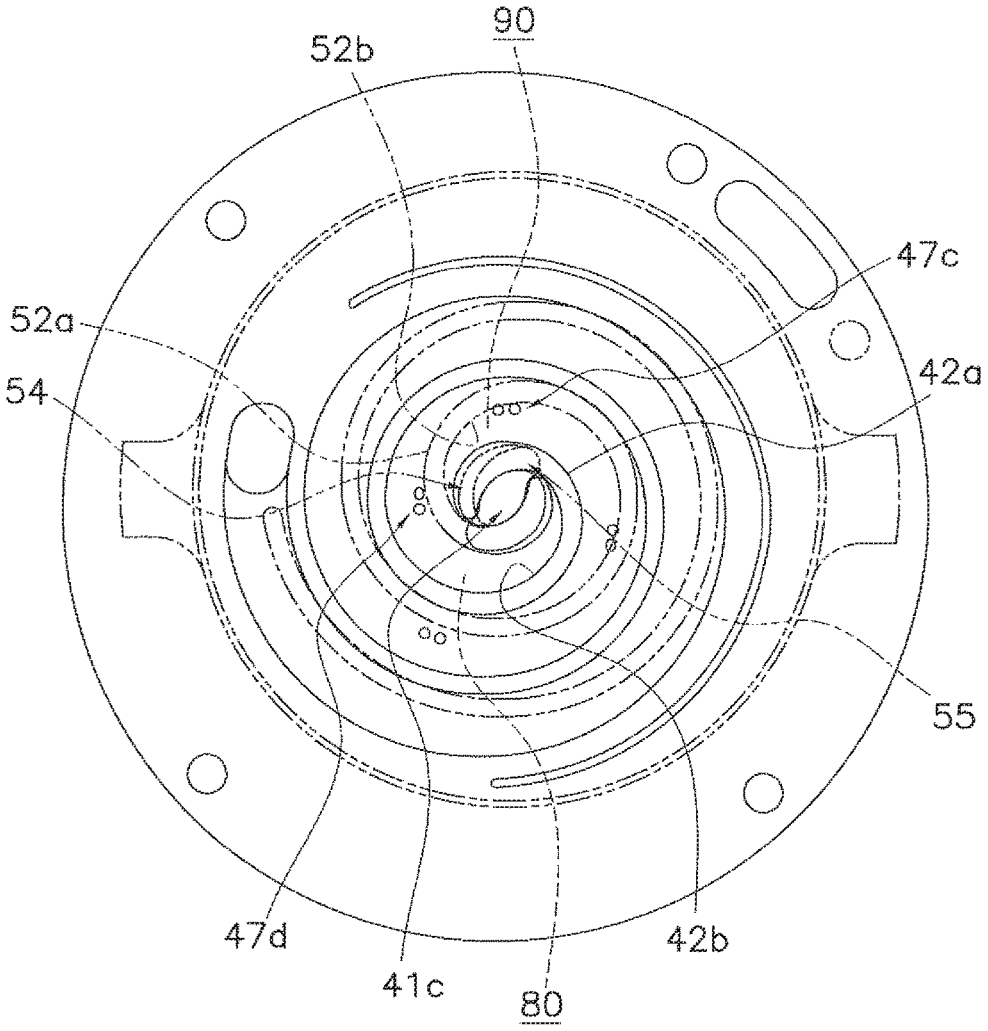
FIG. 7 is a view schematically showing a state where the fixed scroll and the movable scroll of the scroll compressor of FIG. 1 are coupled, which is a view transparently showing, from below, a movable-side plate in the state where the fixed scroll and the movable scroll are coupled, illustrating a configuration of the movable scroll with two-dot dashed lines, FIG. 7 illustrating a state immediately prior to a first compression chamber communicating with the discharge port via a side face gap between a fixed-side lap and a movable-side lap.

A recessed part 56 is formed near the center of the front face 51*a* of the movable-side plate 51 (see FIGS. 5 and 6). The recessed part 56 is formed so as to recess downward with respect to a surface against which a tip 42*c* of the fixed-side lap 42 (tip of the fixed-side lap 42) slides (see FIG. 5). When the recessed part 56 traverses below the tip 42*c* of the fixed-side lap 42, a space between the movable-side plate 51 and the fixed-side lap 42 is not sealed (see FIG. 5).

The recessed part 56 is formed so as to allow the second compression chamber 90 (B chamber) and the discharge port 41*c* to communicate. In particular, the recessed part 56 is formed such that the second compression chamber 90 in a latter stage of compression (latter half of the compression stroke) and discharge port 41*c* communicate via a gap between the tip 42*c* of the fixed-side lap 42 and the recessed part 56 before communicating via a side face gap between the fixed-side lap 42 and the movable-side lap 52. Also, the recessed part 56 is formed such that the second compression chamber 90 in the latter stage of compression (latter half of the compression stroke) communicates with the discharge port 41*c* via the gap between the tip 42*c* of the fixed-side lap 42 and the recessed part 56 before communicating with the centermost relief hole 47 (i.e., the fourth relief hole 47*d*) of the fixed-side plate 41.

The recessed part 56 includes a step 56*a* (see FIGS. 5 and 6). The recessed part 56 is divided by the step 56*a* into a first-opening recessed part 54, and a discharge counterbored part 55 which has a deeper recessed depth than the first-opening recessed part 54 (recesses further downward than the first-opening recessed part 54). The first-opening recessed part 54 is an exemplary first recessed part. The discharge counterbored part 55 is an exemplary second recessed part.

The first-opening recessed part 54 is formed in a shape matching with the fixed-side lap 42. Therefore, an arrangement of the first-opening recessed part 54 with respect to the fixed-side lap 42 change as noted below.

Figure 8:
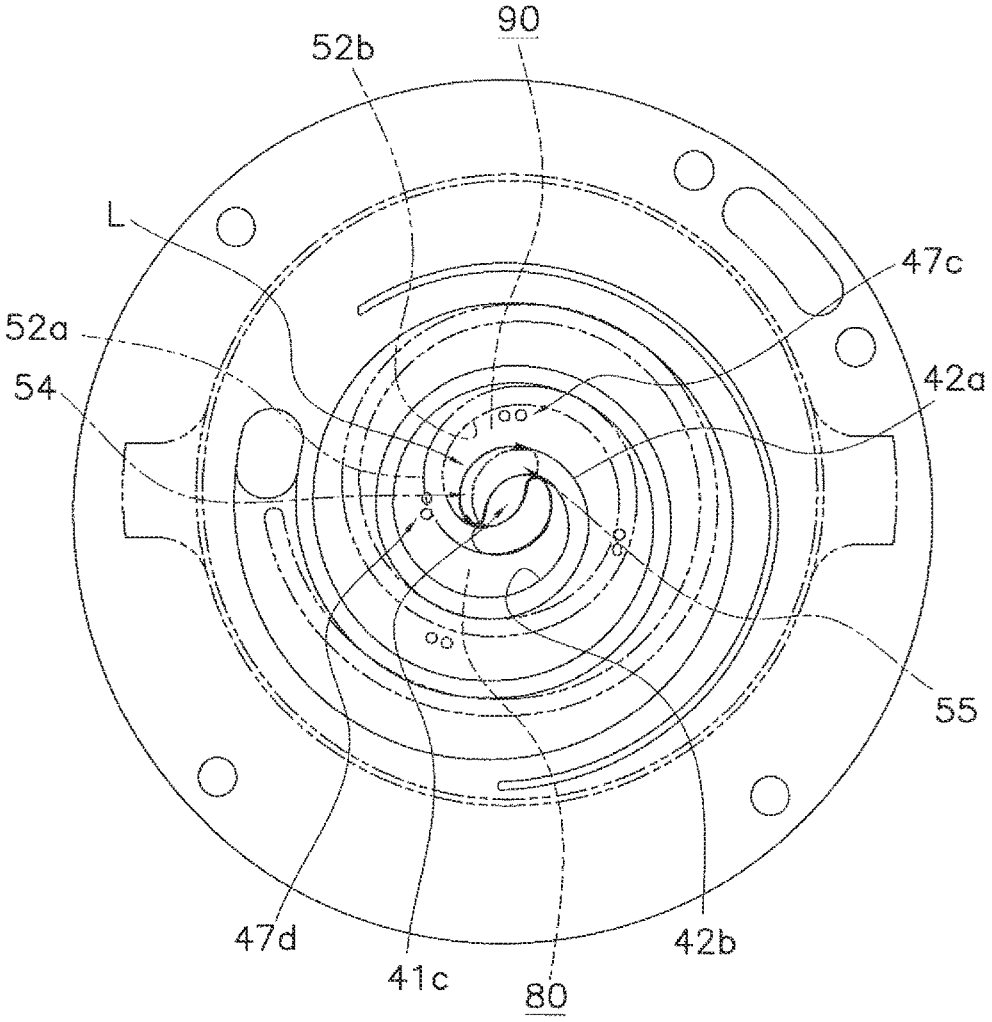
FIG. 8 is a view schematically showing a state where the fixed scroll and the movable scroll of the scroll compressor of FIG. 1 are coupled, which is a view transparently showing, from below, the movable-side plate in the state where the fixed scroll and the movable scroll are coupled, illustrating a configuration of the movable scroll with two-dot dashed lines.

At a certain timing during one cycle of the compression mechanism 30, as shown in FIG. 8, the entirety of one end (a left end in FIG. 8) of the first-opening recessed part 54 overlaps a portion of the outer peripheral face 42*a* of the fixed-side lap 42 in a plan view. At a point in time where the first-opening recessed part 54 and the fixed-side lap 42 are arranged in this way, the second compression chamber 90 and the discharge port 41*c* begin to communicate via the gap between the first-opening recessed part 54 and the tip 42*c* of the fixed-side lap 42. It is noted that, at this point in time, the second compression chamber 90 and the discharge port 41*c* do not communicate via the side face gap between the fixed-side lap 42 and the movable-side lap 52. Specifically, prior to communicating via the side face gap between the fixed-side lap 42 and the movable-side lap 52, the second compression chamber 90 in the latter stage of compression and the discharge port 41*c* communicate via the gap between the tip 42*c* of the fixed-side lap 42 and the first-opening recessed part 54.

Figure 9:
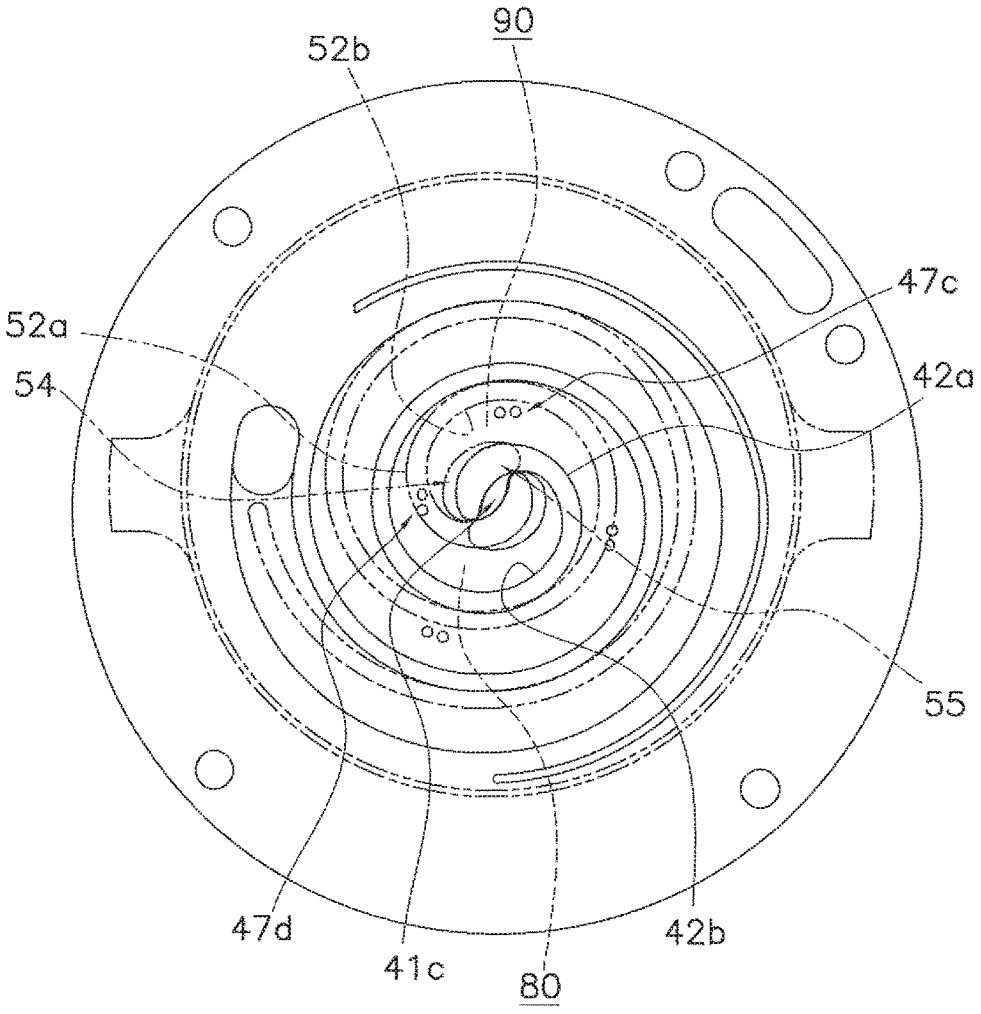
FIG. 9 is a view schematically showing a state where the fixed scroll and the movable scroll of the scroll compressor of FIG. 1 are coupled, which is a view transparently showing, from below, the movable-side plate in the state where the fixed scroll and the movable scroll are coupled, illustrating a configuration of the movable scroll with two-dot dashed lines.

When the crankshaft 70 is further rotated from the state shown in FIG. 8, at a certain timing, the entirety of another end (a right end in FIG. 9) of the first-opening recessed part 54 overlaps a portion of the outer peripheral face 42*a* of the fixed-side lap 42 as shown in FIG. 9. In other words, at a certain timing, the entirety of one end (a left end in FIG. 9) of the discharge counterbored part 55 overlaps a portion of the outer peripheral face 42*a* of the fixed-side lap 42 as shown in FIG. 9. As a result, from this point in time, the second compression chamber 90 and the discharge port 41*c* begin to communicate via the gap between the discharge counterbored part 55 and the tip 42*c* of the fixed-side lap 42.

As shown herein, the second compression chamber 90 in the latter stage of compression and the discharge port 41*c* communicate via the gap between the tip 42*c* of the fixed-side lap 42 and the first-opening recessed part 54, and thereafter, after a predetermined amount of time has elapsed, (in a state where the tip 42*c* of the fixed-side lap 42 does not face the first-opening recessed part 54) the second compression chamber 90 in the latter stage of compression and the discharge port 41*c* communicate via the gap between the tip 42*c* of the fixed-side lap 42 and the discharge counterbored part 55. In other words, in the latter stage of compression of the second compression chamber 90, an edge part of the tip 42*c* of the fixed-side lap 42 on the outer peripheral face 42*a* side of the fixed-side lap 42 faces the first-opening recessed part 54, then faces the discharge counterbored part 55. Specifically, in the latter stage of compression of the second compression chamber 90, after the first-opening recessed part 54 traverses below the edge part of the tip 42*c* on the outer peripheral face 42*a* side of the fixed-side lap 42, then the discharge counterbored part 55 traverses below the edge part of the tip 42*c* on the outer peripheral face 42*a* side of the fixed-side lap 42. In this way, the second compression chamber 90 in the latter stage of compression and the discharge port 41*c* first communicate via an opening having a shallow height (the gap between the tip 42*c* of the fixed-side lap 42 and the first-opening recessed part 54) and, after the predetermined amount of time has elapsed, the second compression chamber 90 in the latter stage of compression and the discharge port 41*c* communicate (without passing through the shallow opening) via a tall opening (the gap between the tip 42*c* of the fixed-side lap 42 and the discharge counterbored part 55). Therefore, even when the recessed part 56 is provided, in high-speed operation/high-pressure ratio conditions, it is possible to maintain comparatively large channel resistance, and an increase in reverse flow loss due to inadequate compression can be suppressed.

The first-opening recessed part 54 is intended to prevent over-compression and to improve efficiency of low-speed/low-pressure ratio conditions. Therefore, a ratio of an opening area A2 formed at the gap between the tip 42*c* of the fixed-side lap 42 and the first-opening recessed part 54 and the opening area A1 of the discharge port 41*c* is designed so as to be equal to a ratio of a minimum rotating speed N2 and the maximum rotating speed N1 of the scroll compressor 10, which are described below (A1:A2=N1:N2). Therefore, while suppressing over-compression loss in the low-speed/low-pressure ratio conditions, channel resistance of the gap between the tip 42*c* of the fixed-side lap 42 and the first-opening recessed part 54 can be kept comparatively high and an increase in reverse flow loss due to inadequate compression can be suppressed in the high-speed/high-pressure ratio conditions.

The opening area A2 between the gap between the tip 42*c* of the fixed-side lap 42 and the first-opening recessed part 54 is expressed as a product of a vertical-direction height H (see FIG. 5) between the tip 42*c* of the fixed-side lap and the first-opening recessed part 54, and a length (for example, a length L indicated by an arrow in the case of FIG. 8) of a portion where the outer peripheral face 42*a* of the fixed-side lap 42 and the first-opening recessed part 54 overlap in a plan view. In other words, a relational expression of A1:A2=N1:N2, as noted above, can be expressed as A1:(H×L)=N1:N2. In actuality, the length of the portion where the outer peripheral face 42*a* of the fixed-side lap 42 and the first-opening recessed part 54 overlap in a plan view changes slightly while changing from the state depicted in FIG. 8 to that of FIG. 9. Therefore, a ratio of the opening area A1, and a product of the height H and an average value of the length of the portion where the outer peripheral face 42*a* of the fixed-side lap 42 and the first-opening recessed part 54 overlap while changing from the state depicted in FIG. 8 to that of FIG. 9, is designed so as to be equal to the ratio of the maximum rotating speed N1 and the minimum rotating speed N2 of the scroll compressor 10.

A key groove 51*c* is formed on the back face 51*b* on a periphery of the movable-side plate 51 (see FIG. 6). An Oldham coupling 33 (see FIG. 1) is fitted into each of the key grooves 51*c*. The Oldham coupling 33 is a member that prevents rotational movement of the movable scroll 50. The Oldham coupling 33 is also fitted into an Oldham groove (not shown in the drawings) formed in the housing 31. The movable scroll 50 is supported by the housing 31 via the Oldham coupling 33.

The boss part 53 is a cylindrical part extending downward from the back face 51*b* of the movable-side plate 51 (see FIG. 1). The boss part 53 is a cylindrical part with a closed upper end. The boss part 53 and an eccentric part 71 are connected as a consequence of the eccentric part 71 of the crankshaft 70 described below being inserted into the boss part 53. When the crankshaft 70, which is connected to the boss part 53 with the eccentric part 71, is rotated, the movable scroll 50 orbits with respect to the fixed scroll 40 without itself rotating due to an action of the Oldham coupling 33, and refrigerant within the compression chambers Sc (first compression chamber 80 and second compression chamber 90) is compressed. More specifically, the compression chambers Sc undergo a decrease in volume while moving towards the center of the fixed-side plate 41 and the movable-side plate 51 due to the orbiting of the movable scroll 50, and along with this, the pressure in the compression chambers Sc increases. Specifically, the pressure of the compression chamber Sc in the center is higher than that of the compression chamber Sc in the periphery. It is noted that the refrigerant compressed by the compression chambers Sc is discharged to the chamber 45 above the discharge port 41*c* which is formed on an upper part of the fixed scroll 40, passes through the refrigerant passage 32 formed in the fixed scroll 40 and the housing 31, and flows toward the space below the housing 31.

(2-2-3) Housing

The housing 31 is a member arranged below the movable-side plate 51 of the movable scroll 50 (see FIG. 1). The housing 31 is press-fitted into the cylinder member 21 of the casing 20, and the entire circumference of an outer peripheral face of the housing 31 is fixated to an inner peripheral face of the cylinder member 21. The fixed scroll 40 is arranged above the housing 31 so that an upper end face of the housing 31 contacts to a lower face of the peripheral part 43 of the fixed scroll 40 (see FIG. 1). The housing 31 and the fixed scroll 40 are fixated to each other by a bolt or the like (not shown in the drawings).

As shown in FIG. 1, a first recess 31*a* is formed at a central upper part of the housing 31. The first recess 31*a* is formed to have a circular shape in a plan view. The boss part 53 of the movable scroll 50, to which the eccentric part 71 of the crankshaft 70 is coupled, is accommodated in an interior of the first recess 31*a*.

An upper bearing 35 supporting the crankshaft 70 is arranged to a lower part of the housing 31 (below the first recess 31*a*; see FIG. 1). The upper bearing 35 includes a bearing housing 35*a* formed to be integral with the housing 31, and a bearing metal 35*b* accommodated within the bearing housing 35*a* (see FIG. 1). The upper bearing 35 rotatably supports a main shaft 72 of the crankshaft 70.

A second recess 31*b* is formed on an upper face of the housing 31 so as to encircle the first recess 31*a* in a plan view. The Oldham coupling 33 is arranged in the second recess 31*b*.

(2-3) Drive Motor

The drive motor 60 is a drive part to drive the movable scroll 50. The drive motor 60 has an annular stator 61 that is fixated to an inner wall face of the cylinder member 21, and a rotor 62 that is rotatably accommodated in the stator 61 with a slight gap (air gap).

The rotor 62 is a cylindrical member and has the crankshaft 70 inserted through an interior thereof. The rotor 62 is coupled to the movable scroll 50 via the crankshaft 70. The movable scroll 50 is driven when the rotor 62 rotates.

The drive motor 60 is operated at a rotating speed in a range at or below the predetermined maximum rotating speed N1 and at or above the predetermined minimum rotating speed N2.

(2-4) Crankshaft

The crankshaft 70 transmits drive power from the drive motor 60 to the movable scroll 50. The crankshaft 70 is arranged so as to extend vertically along the axial center of the cylinder member 21, and connects the rotor 62 of the drive motor 60 and the movable scroll 50 of the compression mechanism 30.

The crankshaft 70 has the main shaft 72, the center axis of which aligns with the axial center of the cylinder member 21, and the eccentric part 71, which is eccentric with respect to the axial center of the cylinder member 21 (center axis of the main shaft 72; see FIG. 1). An oil passage 73 is formed in an interior of the crankshaft 70 (see FIG. 1).

The eccentric part 71 is arranged at an upper end of the main shaft 72, and is coupled to the boss part 53 of the movable scroll 50.

The main shaft 72 is rotatably supported by the upper bearing 35 arranged at the housing 31 and by the lower bearing 75, described below. In addition, the main shaft 72 is coupled to the rotor 62 of the drive motor 60 between the upper bearing 35 and the lower bearing 75. The main shaft 72 rotates around a vertical axis extending in the vertical direction.

The oil passage 73 is a passage for the refrigerating machine oil O, the oil passage 73 supplying the lubricating refrigerating machine oil O to sliding portions of the scroll compressor 10. The oil passage 73 extends in an axial direction of the crankshaft 70, from a lower end to an upper end of the crankshaft 70, and opens at the upper and lower ends of the crankshaft 70. The lower end of the crankshaft 70 is arranged within the oil retention space 25. The refrigerating machine oil O of the oil retention space 25 is conveyed from an opening on a lower end side of the oil passage 73 to an opening on an upper end side. The refrigerating machine oil O flowing through the oil passage 73 flows through an oil channel (not shown in the drawings) which communicates with the oil passage 73, and is supplied to respective sliding portions of the scroll compressor 10. The refrigerating machine oil O which has lubricated the respective sliding portions is returned to the oil retention space 25.

(2-5) Lower Bearing

The lower bearing 75 (see FIG. 1) is arranged below the drive motor 60, and rotatably supports a lower part side of the main shaft 72 of the crankshaft 70. The lower bearing 75 includes a bearing metal 75*a* accommodated within a lower housing 76 (see FIG. 1). The lower housing 76 is secured to the cylinder member 21.

(3) Operation of the Scroll Compressor

Operation of the scroll compressor 10 is described.

(3-1) Compression Operation

When the drive motor 60 is driven, the rotor 62 rotates, and the crankshaft 70 that has been coupled to the rotor 62 also rotates. When the crankshaft 70 rotates, the movable scroll 50 orbits with respect to the fixed scroll 40 without itself rotating, due to an action of the Oldham coupling 33. Thereby, low-pressure (intake-pressure) refrigerant is suctioned into the casing 20 via the intake tube 23. More specifically, the low-pressure refrigerant is suctioned into the compression chambers Sc (first compression chamber 80 and second compression chamber 90) from a periphery side of the compression chambers Sc via the intake tube 23. As the movable scroll 50 orbits, communication between the intake tube 23 and the compression chambers Sc is interrupted, the volume of the compression chambers Sc decreases, and the pressure in the compression chambers Sc accordingly increases. The pressure of refrigerant, over the course of moving from the peripheral side compression chamber Sc to the central side compression chamber Sc, increases and finally reaches a high pressure (discharge pressure). The high-pressure refrigerant that has been compressed by the compression mechanism 30 is discharged from the discharge port 41*c* that is located in the vicinity of the center of the fixed-side plate 41. In addition, in a case where over-compressed gas is produced within the compression chamber Sc (a case where the pressure of the compression chamber Sc is equal to or exceeds a valve closing pressure of the relief valve 147*c*), the over-compressed gas is discharged through the relief holes 47 to the chamber 45. The high-pressure refrigerant in the chamber 45 passes through the refrigerant passage 32 formed in the fixed scroll 40 and the housing 31, and flows into the space below the housing 31.

(3-2) Communication Between the First and Second Compression Chambers and the Chamber Hereafter, communication between the first compression chamber 80 and the second compression chamber 90, and the chamber 45 is described. It is noted that herein, the communication of the first compression chamber 80 and the second compression chamber 90 with the chamber 45 is described with reference to the drawings, particularly as related to a case where the scroll compressor 10 is operated under low-speed/low-pressure ratio conditions (for example, as related to a case where the scroll compressor 10 is operated at close to the minimum rotating speed N2).

Under high-speed/high-pressure ratio conditions (for example, conditions where the scroll compressor 10 is operated at close to the maximum rotating speed N1), the relief valve 147*c* basically does not open and the communication between the first compression chamber 80 or the second compression chamber 90, and the chamber 45 via the relief holes 47 does not occur. In addition, the opening area A2 between the first-opening recessed part 54 and the tip 42*c* of the fixed-side lap 42 is predetermined such that a rise in reverse flow loss is suppressed as much as possible under high-speed/high-pressure ratio conditions.

Figure 10:
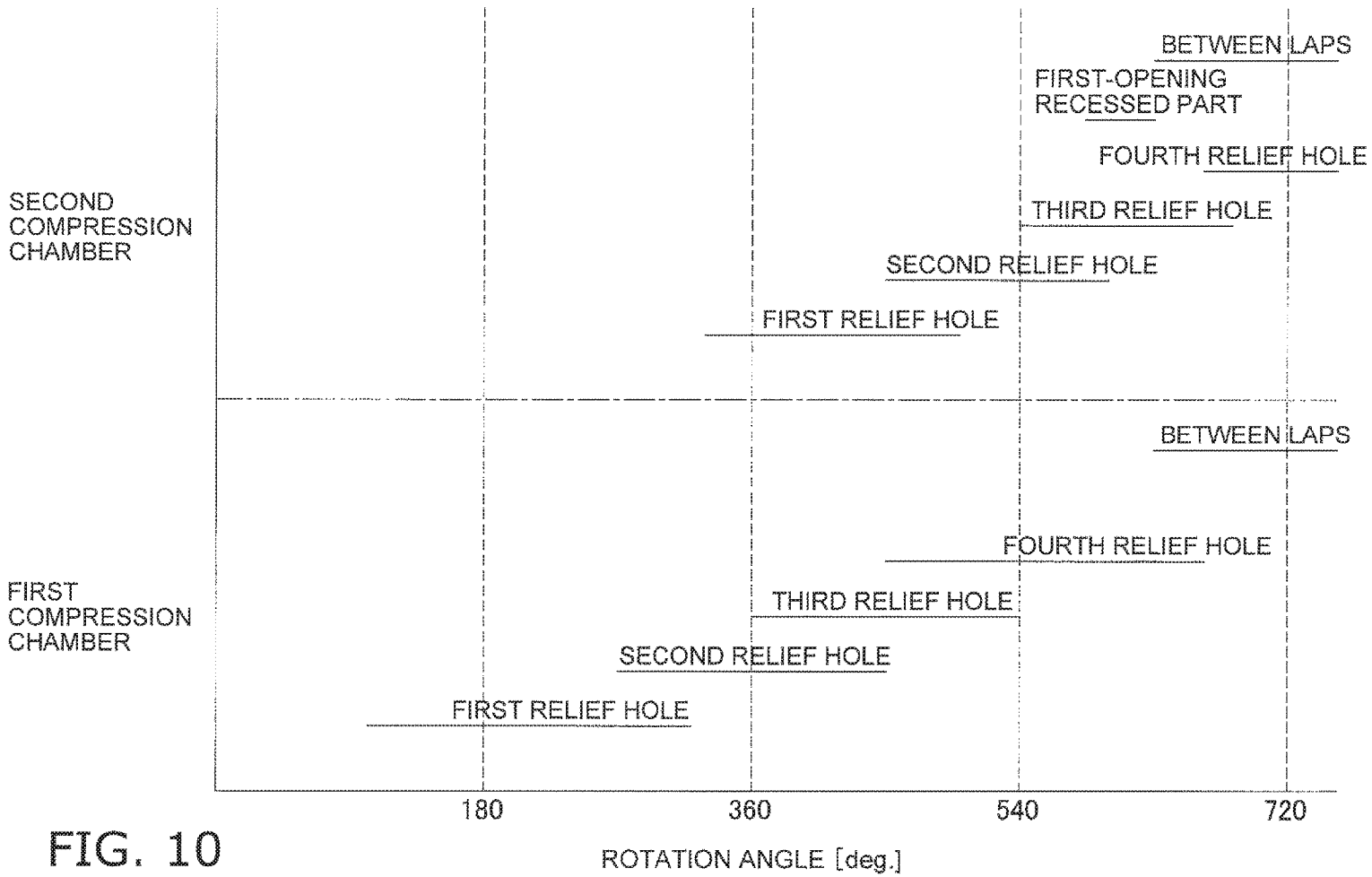
FIG. 10 is a timing chart showing timing of the communication of the first and second compression chambers with a chamber of the scroll compressor of FIG. 1, FIG. 10 illustrating a timing chart with closing of the first compression chamber as a baseline (where a rotation angle at the time of closing the first compression chamber being 0° (deg.))

A lower portion of the timing chart shown in FIG. 10 illustrates the timing at which the first compression chamber 80 and the chamber 45 communicate via the relief holes 47, and via the side face gap between the fixed-side lap 42 and the movable-side lap 52. Meanwhile, an upper portion of the timing chart shown in FIG. 10 illustrates the timing at which the second compression chamber 90 and the chamber 45 communicate via the relief holes 47, via the gap between the tip 42*c* of the fixed-side lap 42 and the first-opening recessed part 54, and via the side face gap between the fixed-side lap 42 and the movable-side lap 52. A horizontal axis in FIG. 10 indicates a rotation angle of the crankshaft 70, with a closing position of the first compression chamber 80 as a baseline (defining the rotation angle of the closing position of the first compression chamber 80 as 0° (deg.)).

Initially, when viewing the timing chart for the communication between the first compression chamber 80 and the chamber 45 in the lower portion of FIG. 10, it may be understood that the first compression chamber 80 and the chamber 45 communicate, in order, via the first relief hole 47*a*, the second relief hole 47*b*, the third relief hole 47*c*, the fourth relief hole 47*d*, and the side face gap between the fixed-side lap 42 and the movable-side lap 52. As may be understood from FIGS. 7 and 10, the first compression chamber 80 communicates with the chamber 45 via the fourth relief hole 47*d* prior to communicating via the side face gap between the fixed-side lap 42 and the movable-side lap 52 and the discharge port 41*c*, and even under low-speed/low-pressure ratio conditions over-compression of the first compression chamber 80 is likely to be prevented.

Next, when viewing the timing chart for the communication between the second compression chamber 90 and the chamber 45 in the upper portion of FIG. 10, it may be understood that the second compression chamber 90 and the chamber 45 communicate, in order, via the first relief hole 47*a*, the second relief hole 47*b*, and the third relief hole 47*c*, prior to the second compression chamber 90 and the chamber 45 communicating via the side face gap between the fixed-side lap 42 and the movable-side lap 52 and the discharge port 41*c*. However, the timing at which the second compression chamber 90 and the chamber 45 communicate via the fourth relief hole 47*d* is after the timing at which the second compression chamber 90 and the chamber 45 communicate via the side face gap between the fixed-side lap 42 and the movable-side lap 52 and the discharge port 41*c*. Based on FIG. 9, as well, which depicts a state immediately prior to the second compression chamber 90 and the chamber 45 communicating via the side face gap between the fixed-side lap 42 and the movable-side lap 52 and the discharge port 41*c*, it may be understood that the second compression chamber 90 is not communicating with the chamber 45 via the fourth relief hole 47*d*. Therefore, the fourth relief hole 47*d* serves a role of assisting transfer of the refrigerant (improving escape of the refrigerant) to the chamber 45 after the second compression chamber 90 and the chamber 45 have communicated via the side face gap between the fixed-side lap 42 and the movable-side lap 52. Despite this, the fourth relief hole 47*d* potentially may not adequately contribute to the prevention of over-compression. However, in the present embodiment, prior to communicating via the side face gap between the fixed-side lap 42 and the movable-side lap 52, the second compression chamber 90 and chamber 45 communicate via the gap between the first-opening recessed part 54 and the tip 42*c* of the fixed-side lap 42 and the discharge port 41*c*. Therefore, over-compression is likely to be adequately suppressed in the second compression chamber 90. Moreover, in the present embodiment, prior to the second compression chamber 90 communicating with the chamber 45 via the fourth relief hole 47*d*, the second compression chamber 90 and chamber 45 communicate via the gap between the discharge counterbored part 55 and the tip 42*c* of the fixed-side lap 42 and the discharge port 41*c*. Therefore, over-compression is likely to be suppressed in the second compression chamber 90.

Figure 11:
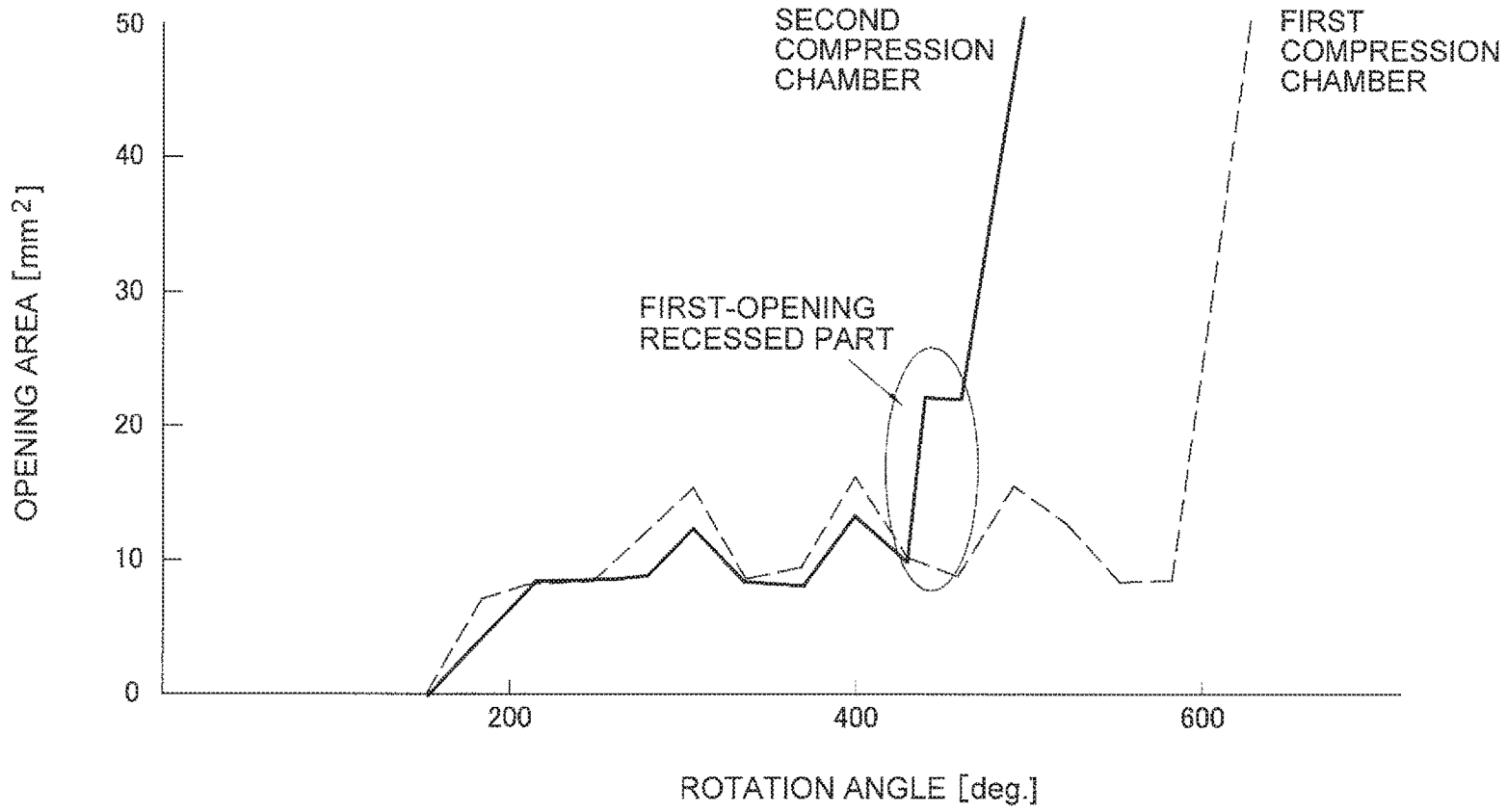
FIG. 11 is a graph showing a change in area of channels (communication area) communicating between the first and second compression chambers and the chamber of the scroll compressor of FIG. 1, the time of closing the first compression chamber being used as a baseline rotation angle (the rotation angle at the time of closing the first compression chamber being defined as 0° (deg.)) in the graph regarding the area of the channel communicating between the first compression chamber and the chamber, the time of closing the second compression chamber being used as a baseline rotation angle (the rotation angle at the time of closing the second compression chamber being defined as 0° (deg.)) in the graph regarding the area of the channel communicating between the second compression chamber and the chamber.

FIG. 11 is a graph illustrating changes in the opening area of the channels through which the first compression chamber 80 and the second compression chamber 90, and the chamber 45 communicate (assuming that all of the relief valves 147*c* are open), relative to the rotation angle of the crankshaft 70. It is noted that, in FIG. 11, with reference to the graph of the opening area of the channels through which the first compression chamber 80 and the chamber 45 communicate, a time of closing the first compression chamber 80 is used as the baseline rotation angle (the rotation angle at the time when the first compression chamber 80 is closed is defined as 0° (deg.)). Also, in FIG. 11, with reference to the graph of the opening area of the channels through which the second compression chamber 90 and the chamber 45 communicate, a time of closing the second compression chamber 90 is used as the baseline rotation angle (the rotation angle at the time when the second compression chamber 90 is closed is defined as 0° (deg.)).

In this embodiment, the first-opening recessed part 54 is formed on the movable-side plate 51. Therefore, it may be understood that prior to the second compression chamber 90 and the chamber 45 communicating via the side face gap between the fixed-side lap 42 and the movable-side lap 52, the opening area increases, and an adequate opening area is likely to be ensured (see FIG. 11). Therefore, over-compression is likely to be adequately suppressed in the second compression chamber 90.

(4) Features 4-1

The scroll compressor 10 according to the present embodiment is provided with the fixed scroll 40 and the movable scroll 50. The fixed scroll 40 includes the fixed-side plate 41, and the fixed-side lap 42 that extends from the front face 41*a* of the fixed-side plate 41. The movable scroll 50 includes the movable-side plate 51, and the movable-side lap 52 that extends from the front face 51*a* of the movable-side plate 51. The fixed-side lap 42 and the movable-side lap 52 are coupled in a state where the front face 41*a* of the fixed-side plate 41 and the front face 51*a* of the movable-side plate 51 face each other, forming the first compression chamber 80 (A chamber) circumscribed by the outer peripheral face 52*a* of the movable-side lap 52 and the inner peripheral face 42*b* of the fixed-side lap 42, and the second compression chamber 90 (B chamber) circumscribed by the inner peripheral face 52*b* of the movable-side lap 52 and the outer peripheral face 42*a* of the fixed-side lap 42 as the compression chambers Sc. The discharge port 41*c* and the relief holes 47 are respectively formed in the fixed-side plate 41, running from the front face 41*a* through to the back face 41*b*. The relief holes 47 communicate for a predetermined amount of time with each of the first compression chamber 80 and the second compression chamber 90. The relief holes 47 are shared by the first compression chamber 80 and the second compression chamber 90. The recessed part 56 is formed on the front face 51*a* of the movable-side plate 51 and allows the second compression chamber 90 and the discharge port 41*c* to communicate. The second compression chamber 90, which is in the latter stage of compression, and the discharge port 41*c* communicate via the gap between the tip 42*c* of the fixed-side lap 42 and the recessed part 56 before communicating via the side face gap between the fixed-side lap 42 and the movable-side lap 52.

In a case where the scroll compressor is provided with the relief holes 47 (in particular, the fourth relief hole 47*d*)

which are shared by the first compression chamber 80 and the second compression chamber 90, in low-speed/low-pressure ratio conditions, it is difficult to adequately suppress over-compression loss of both the first compression chamber 80 and the second compression chamber 90 with only the fourth relief hole 47*d*. Specifically, when attempting to allow the second compression chamber 90 and the fourth relief hole 47*d* to communicate prior to the second compression chamber 90 in the latter stage of compression and the discharge port 41*c* communicating via the side face gap between the fixed-side lap 42 and the movable-side lap 52 in order to adequately suppress over-compression loss of the second compression chamber 90, the position of the fourth relief hole 47*d* needs to be shifted to the earlier stage side. When the fourth relief hole 47*d* is arranged in this way, contrarily, the over-compression loss of the first compression chamber 80 can no longer be adequately suppressed.

In contrast, in the present embodiment, the recessed part 56 is formed on the movable-side plate 51, and prior to communicating via the side face gap between the fixed-side lap 42 and the movable-side lap 52, the second compression chamber 90 and the discharge port 41*c* communicate via the gap between the tip 42*c* of the fixed-side lap 42 and the recessed part 56 of the movable-side plate 51. Therefore, even when the fourth relief hole 47*d* allows the second compression chamber 90 and the chamber 45 to communicate after the second compression chamber 90 and the chamber 45 communicate via the side face gap between the fixed-side lap 42 and the movable-side lap 52, as in the above-described embodiment, over-compression loss of the second compression chamber 90 can be adequately suppressed as the refrigerant flows from the second compression chamber 90 to the chamber 45 via the recessed part 56. Specifically, in this embodiment, the over-compression loss of the second compression chamber 90 can be suppressed using the recessed part 56 and the fourth relief hole 47*d* while maximally suppressing the over-compression loss of the first compression chamber 80 using the fourth relief hole 47*d*, and the over-compression loss of both compression chambers (the first compression chamber 80 and second compression chamber 90) can be effectively suppressed.

Also, in this embodiment, an increase in dead volume of the compression chambers Sc can be suppressed as compared to a case where separate and independent relief holes are provided to the first compression chamber 80 and the second compression chamber 90.

4-2

In the scroll compressor 10 of the present embodiment, the recessed part 56 includes the step 56*a*. The recessed part 56 is divided by the step 56*a* into the first-opening recessed part 54 (first recessed part) and the discharge counterbored part 55 (second recessed part), which has a deeper recessed depth than the first-opening recessed part 54. In a latter stage of compression of the second compression chamber 90 (latter half of the compression stroke), the edge part of the tip 42*c* of the fixed-side lap 42 on the outer peripheral face 42*a* side of the fixed-side lap 42 faces the discharge counterbored part 55 after facing the first-opening recessed part 54.

In this embodiment, the recessed part 56 includes the step 56*a*, and the first-opening recessed part 54, which is capable of restricting the gap with the tip 42*c* of the fixed-side lap 42 to be comparatively small, is formed. In addition, the edge part of the tip 42*c* of the fixed-side lap 42 on the outer peripheral face 42*a* side of the fixed-side lap 42 faces the first-opening recessed part 54 prior to facing the discharge counterbored part 55, which has a deeper recessed depth. Therefore, when the communication between the second compression chamber 90 and the discharge port 41*c* via the recessed part 56 begins, the gap between the recessed part 56 (first-opening recessed part 54) and the tip 42*c* of the fixed-side lap 42 can be kept comparatively small, and channel resistance can be kept comparatively high during high-speed/high-pressure ratio operation, where a refrigerant circulating volume is large. Accordingly, it is possible to suppress an increase in reverse flow loss due to inadequate compression during high-speed/high-pressure ratio operation.

4-3

In the scroll compressor 10 of the present embodiment, in the latter stage of compression of the second compression chamber 90, the second compression chamber 90 and the fourth relief hole 47*d* communicate with each other after the edge part of the tip 42*c* of the fixed-side lap 42 on the outer peripheral face 42*a* side of the fixed-side lap 42 faces the discharge counterbored part 55.

In this embodiment, before the fourth relief hole 47*d* communicates with the second compression chamber 90, the second compression chamber 90 and the discharge port 41*c* communicate via the gaps between the tip 42*c* of the fixed-side lap 42, and the first-opening recessed part 54 and the discharge counterbored part 55, and the refrigerant flows from the second compression chamber 90 through these gaps and into the discharge port 41*c*. Therefore, when the scroll compressor 10 is operated under low-speed/low-pressure ratio conditions, over-compression loss of the second compression chamber 90 is readily suppressed.

4-4

In the scroll compressor 10 of the present embodiment, the ratio of the opening area A2 formed at the gap between the tip 42*c* of the fixed-side lap 42 and the first-opening recessed part 54 and the opening area A1 of the discharge port 41*c* is equal to the ratio of the minimum rotating speed N2 and the maximum rotating speed N1 of the scroll compressor 10.

In this embodiment, the ratio of the opening area A2 of the gap between the tip 42*c* of the fixed-side lap 42 and the first-opening recessed part 54, and the opening area A1 of the discharge port 41*c*, which is capable of suppressing channel resistance even in a case where the scroll compressor 10 is operated at the maximum rotating speed N1, is equal to the ratio of the minimum rotating speed N2 and the maximum rotating speed N1 of the scroll compressor 10. Therefore, while suppressing over-compression loss at low-speed/low-pressure ratio conditions, at high-speed/high-pressure ratio conditions, channel resistance of the gap between the tip 42*c* of the fixed-side lap 42 and the first-opening recessed part 54 can be kept comparatively high, and an increase in reverse flow loss due to inadequate compression can be suppressed.

(5) Modifications

Modifications of the present embodiment are indicated below. A plurality of modifications may also be combined as appropriate.

(5-1) Modification A

In the scroll compressor 10 of the above-described embodiment, each of the relief holes 47 includes a pair of round holes 147*a*. However, such an arrangement is not provided by way of limitation. For example, each of the relief holes 47 may instead have one, or three or more round holes 147*a*. Also, the shape of the hole included in the relief hole 47 and famed in the front face 41*a* of the fixed-side plate 41 is not limited to a round hole and a variety of shapes can be employed for holes.

(5-2) Modification B

In the scroll compressor 10 of the above-described embodiment, the recessed part 56 formed on the movable-side plate 51 includes the step 56*a*, and is divided into the first-opening recessed part 54 and the discharge counterbored 55, which have different recessed depths. However, such an arrangement is not provided by way of limitation. For example, the movable-side plate may be a member which includes a recessed part having a uniform recessed depth without a step. However, by providing the step to the recessed part and dividing the recessed part into the first-opening recessed part 54 and the discharge counterbored 55, which have different recessed depths, over-compression loss in low-speed/low-pressure ratio conditions and reverse flow loss in high-speed/high-pressure ratio conditions are both likely to be readily achieved.

(5-3) Modification C

In the scroll compressor 10 of the embodiment described above, the recessed part 56 formed on the movable-side plate 51 includes the step 56*a* in a single location. However, such an arrangement is not provided by way of limitation. The recessed part 56 may include more than one step, and may be divided into more than two regions having different depths.

(5-4) Modification D

In the embodiment described above, the recessed part 56 allowing the second compression chamber 90 and the discharge port 41*c* to communicate is formed on the movable-side plate 51. In addition, the recessed part allowing the first compression chamber 80 and the discharge port 41*c* to communicate may be further formed on the fixed-side plate 41.

(5-5) Modification E

In the embodiment described above, the relief holes 47 are formed in four locations. However, such an arrangement is not provided by way of limitation. The relief holes 47 may instead be formed at one to three locations, or at five or more locations. For example, the fourth relief hole 47*d* alone may be formed on the fixed-side plate 41 as the relief hole 47.

(5-6) Modification F

The timing chart of FIG. 10 according to the embodiment described above is exemplary, and such an arrangement is not provided by way of limitation.

For example, in the scroll compressor 10, in the latter stage of compression of the second compression chamber 90, the second compression chamber 90 and the fourth relief hole 47*d* may communicate with each other after the edge part of the tip 42*c* of the fixed-side lap 42 on the outer peripheral face 42*a* side of the fixed-side lap 42 faces the first-opening recessed part 54 and before the edge part of the tip 42*c* of the fixed-side lap 42 on the outer peripheral face 42*a* side of the fixed-side lap 42 faces the discharge counterbored part 55.

In this case, before the fourth relief hole 47*d* communicates with the second compression chamber 90, the second compression chamber 90 and the discharge port 41*c* communicate via the gap between the tip 42*c* of the fixed-side lap 42 and the first-opening recessed part 54, and the refrigerant flows from the second compression chamber 90 through this gap and into the discharge port 41*c*. Therefore, when the scroll compressor 10 is operated under low-speed/low-pressure ratio conditions, over-compression loss of the second compression chamber 90 is readily suppressed.

(5-7) Modification G

In the embodiment described above, the opening area formed in the gap between the tip 42*c* of the fixed-side lap 42 and the first-opening recessed part 54 is designed to be substantially constant during communication (in a period from the state shown in FIG. 8 until achieving the state shown in FIG. 9). However, such an arrangement is not provided by way of limitation. An opening area formed in the gap between the tip 42*c* of the fixed-side lap 42 and the first-opening recessed part 54 may instead be designed so as to, for example, grow progressively larger after communication begins.

(5-8) Modification H

In the scroll compressor 10 of the embodiment described above, the recessed part 56 formed on the movable-side plate 51 includes the step 56*a*. However, such an arrangement is not provided by way of limitation. The recessed part 56 may instead have a slope where depth changes continuously.

INDUSTRIAL APPLICABILITY

The present invention is useful as a scroll compressor capable of effectively suppressing over-compression loss in both an A chamber and a B chamber.

REFERENCE SIGNS LIST

10 Scroll compressor
40 Fixed scroll
41 Fixed-side plate
41*a* Front face of fixed-side plate
41*b* Back face of fixed-side plate
41*c* Discharge port
42 Fixed-side lap
42*a* Outer peripheral face of fixed-side lap
42*b* Inner peripheral face of fixed-side lap
42*c* Tip of fixed-side lap
47 Relief hole
47*d* Fourth relief hole (relief hole)
50 Movable scroll
51 Movable-side plate
51*a* Front face of movable-side plate
52 Movable-side lap
52*a* Outer peripheral face of movable-side lap
52*b* Inner peripheral face of movable-side lap
54 First-opening recessed part (first recessed part)
55 Discharge counterbored part (second recessed part)
56 Recessed part
56*a* Step

80 First compression chamber
90 Second compression chamber
A1 Opening area of discharge port
A2 Opening area formed by gap between tip of fixed-side lap and first-opening recessed part
N1 Maximum rotating speed
N2 Minimum rotating speed
Sc Compression chamber

CITATION LIST

Patent Literature

PATENT LITERATURE 1: Japanese Laid-open Patent Publication 2011-149376

What is claimed is:

1. A scroll compressor comprising:

a fixed scroll having a fixed-side plate and a fixed-side lap extending from a front face of the fixed-side plate; and a movable scroll having a movable-side plate and a movable-side lap extending from a front face of the movable-side plate, the fixed-side lap and the movable-side lap being coupled in a state where the front face of the fixed-side plate and the front face of the movable-side plate face each other, and forming a first compression chamber circumscribed by an outer peripheral face of the movable-side lap and an inner peripheral face of the fixed-side lap and a second compression chamber circumscribed by an inner peripheral face of the movable-side lap and an outer peripheral face of the fixed-side lap, the fixed side plate including a discharge port and a relief hole respectively formed therein, the discharge port and the relief hole extending from the front face through to a back face, the relief hole communicating for a predetermined amount of time with each of the first compression chamber and the second compression chamber and being shared by the first compression chamber and the second compression chamber, the front face of the movable-side plate including a recessed part formed thereon allowing the second compression chamber and the discharge port to communicate, the recessed part recessing toward a direction away from the fixed-side plate, the second compression chamber, during a latter stage of compression, and the discharge port communicating via a gap formed between a tip of the fixed-side lap and the recessed part before communicating via a side face gap formed between the fixed-side lap and the movable-side lap, the recessed part including a step and the recessed part being divided by the step into a first recessed part further separated from the front face of the fixed-side plate than the front face of the movable-side plate is separated from the front face of the fixed-side plate and a second recessed part having a deeper recessed depth than the first recessed part and being further separated from the front face of the fixed-side plate than the first recessed part is separated from the front face of the fixed-side plate, and the front face of the movable plate, the first recessed part and the second recessed part being aligned in order along a relative moving direction of the fixed-side lap with respect to the movable-side plate when the second compression chamber communicates with the discharging port.

2. The scroll compressor according to claim 1, wherein during the latter stage of compression of the second compression chamber, the second compression chamber and the relief hole communicate with each other after the edge part of the tip of the fixed-side lap on the outer peripheral face side of the fixed-side lap faces the second recessed part.

3. The scroll compressor according to claim 1, wherein during the latter stage of compression of the second compression chamber, the second compression chamber and the relief hole communicate with each other after the edge part of the tip of the fixed-side lap on the outer peripheral face side of the fixed-side lap faces the first recessed part and before the edge part of the tip of the fixed-side lap on the outer peripheral face side faces the second recessed part.

4. A scroll compressor comprising:

a fixed scroll having a fixed-side plate and a fixed-side lap extending from a front face of the fixed-side plate; and a movable scroll having a movable-side plate and a movable-side lap extending from a front face of the movable-side plate, the fixed-side lap and the movable-side lap being coupled in a state where the front face of the fixed-side plate and the front face of the movable-side plate face each other, and forming a first compression chamber circumscribed by an outer peripheral face of the movable-side lap and an inner peripheral face of the fixed-side lap and a second compression chamber circumscribed by an inner peripheral face of the movable-side lap and an outer peripheral face of the fixed-side lap, the fixed side plate including a discharge port and a relief hole respectively formed therein, the discharge port and the relief hole extending from the front face through to a back face, the relief hole communicating for a predetermined amount of time with each of the first compression chamber and the second compression chamber and being shared by the first compression chamber and the second compression chamber, the front face of the movable-side plate including a recessed part formed thereon allowing the second compression chamber and the discharge port to communicate, the second compression chamber, during a latter stage of compression, and the discharge port communicating via a gap formed between a tip of the fixed-side lap and the recessed part before communicating via a side face gap formed between the fixed-side lap and the movable-side lap, the recessed part including a step and the recessed part being divided by the step into a first recessed part and a second recessed part having a deeper recessed depth than the first recessed part, during the latter stage of compression of the second compression chamber, an edge part of the tip of the fixed-side lap on an outer peripheral face side of the fixed-side lap facing the second recessed part after facing the first recessed part, and a ratio of an opening area of the gap formed between the tip of the fixed-side lap and the first recessed part to an opening area of the discharge port being equal to a ratio of a minimum rotating speed to a maximum rotating speed of the scroll compressor.

5. The scroll compressor according to claim 4, wherein during the latter stage of compression of the second compression chamber, the second compression chamber and the relief hole communicate with each other after the edge part of the tip of the fixed-side lap on the outer peripheral face side of the fixed-side lap faces the second recessed part.

6. The scroll compressor according to claim 4, wherein during the latter stage of compression of the second compression chamber, the second compression chamber and the relief hole communicate with each other after the edge part of the tip of the fixed-side lap on the outer peripheral face side of the fixed-side lap faces the first recessed part and before the edge part of the tip of the fixed-side lap on the outer peripheral face side faces the second recessed part.

* * * * *